US007509827B2

(12) United States Patent
Hellgren

(10) Patent No.: US 7,509,827 B2
(45) Date of Patent: Mar. 31, 2009

(54) DEVICE AND METHOD FOR EXPANSION FORMING

(75) Inventor: Keijo Hellgren, Västerås (SE)

(73) Assignee: Avure Technologies AB, Vasteras (SE)

( * ) Notice: Subject to any disclaimer, the term of this patent is extended or adjusted under 35 U.S.C. 154(b) by 512 days.

(21) Appl. No.: 10/513,707

(22) PCT Filed: Apr. 4, 2003

(86) PCT No.: PCT/SE03/00543

§ 371 (c)(1),
(2), (4) Date: Aug. 10, 2005

(87) PCT Pub. No.: WO03/095122

PCT Pub. Date: Nov. 20, 2003

(65) Prior Publication Data

US 2006/0075796 A1 Apr. 13, 2006

Related U.S. Application Data

(60) Provisional application No. 60/380,424, filed on May 13, 2002.

(30) Foreign Application Priority Data

May 8, 2002 (SE) ..... 0201415
May 15, 2002 (SE) ..... 0201470

(51) Int. Cl.
*B21D 26/02* (2006.01)
*B21D 22/12* (2006.01)

(52) U.S. Cl. ..... 72/61; 72/58; 72/63

(58) Field of Classification Search ..... 72/58, 72/61, 62, 63, 370.22
See application file for complete search history.

(56) References Cited

U.S. PATENT DOCUMENTS

| | | | | |
|---|---|---|---|---|
| 3,120,205 | A | 2/1964 | Pfeiffer et al. | 113/44 |
| 4,079,613 | A * | 3/1978 | Syvakari | 72/63 |
| 4,317,348 | A * | 3/1982 | Halene et al. | 72/62 |
| 4,676,086 | A * | 6/1987 | Hellgren | 72/63 |
| 4,966,029 | A * | 10/1990 | Zbornik | 72/379.2 |
| 5,927,120 | A | 7/1999 | Marando | 72/61 |
| 6,041,633 | A * | 3/2000 | Bieling | 72/61 |
| 6,530,252 | B1 * | 3/2003 | Hashimoto et al. | 72/58 |
| 6,634,198 | B2 | 10/2003 | Dudziak | 72/57 |
| 7,047,780 | B2 * | 5/2006 | Marando et al. | 72/61 |
| 2002/0088263 | A1 | 7/2002 | Dudziak | 72/63 |

FOREIGN PATENT DOCUMENTS

| | | |
|---|---|---|
| EP | 0 873 802 A1 | 10/1998 |
| EP | 1 216 769 A2 | 6/2002 |
| SE | 450 227 | 6/1987 |
| WO | WO 00/00309 | 1/2000 |
| WO | WO 02/43890 A1 | 6/2002 |

* cited by examiner

*Primary Examiner*—David B Jones
(74) *Attorney, Agent, or Firm*—Harness, Dickey & Pierce, PLC

(57) ABSTRACT

The present invention relates to a method and a device for expansion forming of an article. According to at least one aspect of the invention, an expansion forming tool is pressure-compensated from two sides, pressure differences on each side being equalized by means of a pressure transmitter, which is applicable to the tool.

36 Claims, 5 Drawing Sheets

DEVICE AND METHOD FOR EXPANSION FORMING

The present application claims priority of U.S. Provisional Application No. US 60/380,424 and Swedish Applications Nos SE 0201415-7 and SE 0201470-2.

TECHNICAL FIELD

The present invention relates to a device and a method for expansion forming of an article using a blank adapted to be formed into said article in the cavity of an expansion forming tool.

BACKGROUND ART

Tubular articles are used in different industrial applications. In the automotive industry, the cars manufactured may, for example, be provided with tubular side beams and also with bodies of so-called space frame construction. It would seem convenient to manufacture these types of tubular articles by means of expansion forming.

In expansion forming, an expansion forming tool is used. The tool comprises a cavity having the shape intended for a finished article. The tool usually comprises two milled-out tool halves made of steel, the recess in the tool halves forming the cavity. An initial blank having a hollow space is pre-bent to fit the cavity and is thus arranged between the tool halves, which are then closed against one another. One end of the blank enclosed by the tool is sealed and a pressure medium is supplied at the other end, for example by means of a tubular lance provided with a seal, which is inserted in the pre-calibrated tubular mouth of the blank.

The expansion forming is achieved, for example, by means of hydroforming. This means that a pressure medium, such as oil or another liquid, is pumped into the hollow space of the blank. The forming pressure of the pressure medium pumped in is usually in the range of 1000-6000 bar, but both lower and higher pressures can be used. The choice of forming pressure depends on different parameters, such as the material, shape and desired tolerances of the article.

Conventionally, a press platen is used which covers the upper side and/or the under side of the tool and which is applied to the tool by means of the closing force of the press. The forming pressure generated in the tool by means of the pressure medium will produce an opening force aiming at separating the tool halves. Thus, the opening force is generated by the forming pressure of the blank multiplied by the area of the exposed blank transversely to the closing force. In the case of large blanks having large areas of exposure and high forming pressures, large opening forces are generated. When combined with large platen areas, this results in large tolerances for the formed product. It is difficult to keep the downward deflections in large press platens within the desired limits. When great forces are involved (more than 10,000 tons, i.e. about 100 MN), building plants in conventional manner becomes financially doubtful. The forming tools and, possibly, the press platens would need to be very thick. Examples of possible deformations are illustrated in the accompanying FIGS. 2*a-b* and 3*a-b*.

WO 00/00309 A1 discloses a device and a method for expansion forming. In this specification, a pressure cell provided with a diaphragm is used, which exerts a pressure both on a pressure intensifier to generate an internal forming pressure in a tool and on the tool itself. The pressure cell provided with diaphragm contributes to the drawbacks mentioned above being alleviated, since the force used to close the tool is transmitted by the diaphragm through a pressure medium and is evenly distributed over the upper side of the tool. Although such an arrangement has certain advantages compared with conventional press platens, it is still not enough to prevent deformations of the tool or avoid unevenly distributed loads at very high pressures. Consequently, more rigid tools would be required also in this case, which is a problem because it means that a thicker tool is needed to obtain the desired rigidity.

Accordingly, it is desirable to be able to form large articles at a reasonable cost.

SUMMARY OF THE INVENTION

One object of the present invention is to provide a device and a method which alleviate at least one of the above problems.

Another object of the present invention is to provide a device and a method which allow inexpensive expansion forming of large articles.

These and other objects, will be evident from the following description, are achieved by means of a device and a method, which have the features indicated in the appended claims.

According to one aspect of the invention, a device for expansion forming of an article is provided which is used in conjunction with a press. The device comprises an expansion forming tool, which comprises at least one cavity adapted to receive a blank having an inner hollow space. The device further comprises at least one pressure intensifier adapted to pressurize a pressure medium in the hollow space of the blank in such manner that the blank is forced against the wall of the forming space, the blank being thus expanded into an article shaped according to the shape of the cavity. Moreover, a first and a second pressure transmitter are provided, which are applicable on respectively a first and a second outer face of the tool for exerting pressure thereon. The first and the second outer face are located opposite one another and oriented away from one another. In addition, each pressure transmitter is adapted to equalize, during the expansion forming, pressure differences between different portions of said outer face.

Accordingly, the invention is based on the understanding that two-sided pressure compensation adapted to equalize deviations in the pressure exerted on the tool can be used to prevent tool deformations even in tools with relatively poor rigidity and small material thickness. This involves a difference from the prior-art press, in which a pressure transmitter in the form of a diaphragm is used from one side only. In such a press provided with a diaphragm, the diaphragm may also be used to form, for example, an intermediate sheet against an underlying one-sided forming tool, the diaphragm being caused to press the sheet against the forming tool. Therefore, it has never been thought of to equip traditional presses with an additional pressure transmitter of this kind, since the latter would appear not to be of any use in, for example, the sheet-metal pressing application, but rather an encumbrance, if anything.

Pressure transmitter here means a means that transmits or transfers a pressure by acting as a link or connection, such as a contact surface. Thus, pressure transmitters are adapted to transfer a built-up pressure or create a counter pressure to the expansion forming tool. Another characteristic of the pressure transmitters is their ability to distribute and equalize pressure differences over the tool surface, which means that they have an inherent flexibility. The pressure transmitters are preferably adapted to exert forces on the tool which are essentially perpendicular to the outer surface of the tool.

Preferably, at least one of the pressure transmitters comprises a flexible element, which defines a pressure cell adapted to be filled with a liquid. Thus, when the pressure cell is filled and pressurised and the flexible element applied to one of the outer faces of the forming tool, the element will act as the boundary surface of a liquid cell. During the expansion forming, the internal forming forces in the tool will be compensated for by a liquid pressure exerted by the pressure cell or the liquid cell, said liquid pressure being transmitted through the flexible element. The liquid is preferably oil, but also other liquids can be used, such as water. Pressure transmitters can also act, together with the pressure cell, as a closing means for keeping the tool in a closed position and, for example, preventing the tool halves, if any, from being separated before the actual expansion forming.

Suitably, the first and the second pressure transmitter both comprise said type of pressure cell with a flexible element. The internal forming forces are then counteracted on both sides of the essentially incompressible liquid. The two pressure cells are conveniently connected to a common hydraulic system, although, as an alternative, they may each be connected to a separate system. The hydraulic system comprises a liquid source, which supplies the two pressure cells with liquid. This allows the same pressure to be achieved, in a simple manner, in the two pressure cells, which means that the expansion forming tool can be subjected to the same pressure from both sides. The more liquid supplied, the higher the pressure generated in the pressure cells. Hence, this is a matter of active generation of forces, in which process it is possible to choose the desired counter pressure to be applied to the outer faces of the expansion forming tool. In a way, the two-sided pressure compensation makes the tool float.

Although outer liquid pressures transmitted through a flexible element can be advantageously applied to both sides of the tool, there are other alternatives. For instance, the first pressure transmitter can comprise a flexible element, which defines a pressure cell adapted to be filled with liquid, while the second pressure transmitter comprises a passive element, such as a soft pad made of an elastomer or an equivalent rubber-like material. The passive element is preferably provided with a seal along its circumference to prevent extrusion thereof. The first pressure transmitter with a pressure cell will thus actively exert a force on the tool, while the second flexible pressure transmitter remains passive and is acted upon through the tool by the first pressure transmitter. The pressure distribution in the soft, passive element is essentially hydrostatic and equalizes pressure differences in a manner corresponding to that of the pressure cell with the flexible element.

The flexible element can, for instance, comprise an elastic diaphragm, for example of the type described in WO 00/00309 A1. Thus, according to at least one embodiment of the present invention, a pressure cell having a first diaphragm, which is applicable to a first outer face, such as an upper side, of the expansion forming tool, and a pressure cell having a second diaphragm, which is applicable to a second outer face, such as an under side, of the tool are provided.

As an alternative, the flexible element may instead be a lamella, a disk or a plate, preferably of metal, for example high-strength sheet metal, such as sheet steel. The plate forms, together with an opposite wall and two perpendicular side walls, a pressure cell. The periphery or circumference of the plate is provided with a seal against the side walls such that the pressure cell is sealed and no liquid is allowed to flow past the plate. The plate is similar to a short piston, since the plate, with its seal, can be arranged in a reciprocating manner. If the plate initially is located near the opposite wall, i.e. in a retracted position, the liquid, for example hydraulic oil, that is supplied to the pressure cell will force the plate to move and the pressure cell expands. When the forming operation has been completed, the pressure cell can be emptied and, if desirable, the plate is returned to a retracted position, i.e. the volume of the pressure cell is reduced, which may be advantageous if it facilitates the access to the forming tool. This can be achieved, for example, by means of vacuum suction of the pressure cell. Alternatively, it can be achieved by the plate being provided with a spring arrangement, which aims at keeping the plate in a position close to the opposite wall, or by means of lifting hydraulic pistons, etc.

The plate, or the low piston, is designed to have a such a weakness that it allows a certain degree of flexibility without its yield point being exceeded at the pressure levels used. Thus, the plate should not be absolutely rigid. The thickness of the plate is determined by the internal forming pressure to be compensated. Owing to its flexibility, the plate can be easily tilted to allow for parallelism deviations in the expansion forming tool.

Thus, according to at least one embodiment of the invention, use is made of a pressure cell having a first flexible plate, which is applicable to a first outer face, such as an upper side, of the expansion forming tool, and a pressure cell having a second flexible plate, which is applicable to a second outer face, such as an under side, of the tool.

It will also be appreciated that it is possible, for example, to combine one pressure cell provided with a diaphragm and one pressure cell provided with a flexible plate, or any one of these with a passive pad of the kind described above.

A further variant is conceivable, namely the use of two pad-shaped elements. In this case, the first pressure transmitter and the second pressure transmitter each comprise a pad-shaped element made of an elastomer or an equivalent rubber-like material. These pad-shaped elements, possibly provided with a surrounding cover, are thus each adapted to abut against an outer face of the tool. To achieve pressure compensation, a force-exerting means is arranged to exert a force in the direction of the tool on at least one of the pad-shaped elements. This can be achieved in different ways, for example by means of hydraulic pistons that force a press platen against the pad-shaped element, said element transmitting the force to the tool. The second pad-shaped element could also be exposed to an active application of a force. However, it is enough for the second pad-shaped element to abut with one side against the tool, the other side being supported only by a structure arranged behind, for example a fixed plate or part of the press body proper. In this way, both pad-shaped elements will be exposed to the force, the difference being that the first element will be directly acted upon by said force-exerting means, whereas the second element will be acted upon by the tool. Both elements will, however, contribute to the pressure-compensation in the desired manner.

An expansion forming tool conveniently comprises, in conventional manner, two separable tool parts, such as two tool halves. When a blank has been arranged in the cut-out in one of the tool parts, the other tool part is placed on top of the latter, so that the blank is completely enclosed in the cavity formed by the cut-out in the tool parts. During the actual expansion forming, the high internal pressure will aim at opening the expansion forming tool. It may, therefore, be advantageous to exert a pressure from the outside on the outer faces of the tool that are parallel to the contact surface or joint surface of the tool parts, so that the parts are kept together. According to at least one embodiment of the invention, a first and a second pressure transmitter are thus applied to respectively a first and a second outer face of the expansion tool, said faces being parallel to said joint surface. The joint surface is usually horizontal, which means that said outer faces constitute the upper side and the under side, respectively, of the tool. However, other orientations and inclinations of the joint surface are conceivable.

It will also be appreciated that said first and second outer faces instead can be perpendicular to the joint surface of the tool parts. This may be the case if a thick tool is used, the parallel sides of which can be supported with the aid of conventional means, while any perpendicular side walls are thin and, therefore, conveniently supported by means of two pressure transmitters according to the invention.

A forming tool usually has the shape of a rectangular parallelepiped, i.e. it has six outer faces. At one side, the pressure medium causing the internal pressure is introduced. The opposite side thereof is provided with a seal or plugs. These sides are exposed to a relatively small opening force, since the exposed area is small. If a long, tubular article, such as beams, is to be formed from an initial blank, the other sides, in which the exposed areas of the blank are larger, will be exposed to large opening forces during the expansion forming. By compensating the other four outer faces by means of pressure transmitters, large forces can be counteracted.

According to at least one embodiment of the invention, a third and a fourth pressure transmitter are thus also provided, which are applicable to respectively a third and a fourth outer face of the tool for exerting a force thereon and which are adapted to equalize pressure differences as described above, the third and the fourth face being located opposite one another and oriented away from one another and the third and the fourth outer face being perpendicular to the first and the second outer face.

Consequently, the vertical and horizontal dimensions of a forming tool, i.e. the upper and lower walls as well as the side walls, can be small despite high internal forming pressures. The tool can be made lighter using less material and/or less strong material.

A pressure transmitter, such as a diaphragm, a flexible plate or a rubber pad, preferably has such a dimension that, during the expansion forming, it covers essentially the whole outer face of the tool to which it is applied. This allows satisfactory pressure equalization and compensation. However, any peripheral seals provided may take up a small area, which means that the pressure transmitter does not necessarily cover the whole area. Each pressure transmitter should, however, cover at least more than 70% of the outer face of a tool, preferably more than 90%, for example more than 95% of said outer face.

The pressure medium used to achieve the internal forming pressure can be, for example, a liquid, such as water or oil, i.e. hydroforming. Another alternative is using an elastomer or other rubber-like material, for instance in the way shown in WO 00/00309 A1, or, as a further alternative, a combination of a liquid and an elastomer. Moreover, any other medium or substance having the equivalent physical properties can also be used.

The above description emphasizes inventive devices. It is obvious, however, that the inventive idea covers also methods. Accordingly, according to another aspect of the invention, a method for expansion forming of an article is provided. According to the method, a blank having an inner hollow space is arranged in the cavity of an expansion forming tool. A pressure medium is pressurised in the hollow space of the blank in such manner that the blank is forced against the wall of the cavity, the blank being thus expanded into an article shaped according to the shape of the cavity. Furthermore, pressure is exerted on a first and a second outer face of the expansion forming tool and pressure differences between different portions of each face are equalized during the expansion forming, the first and the second outer face being located opposite one another and oriented away from one another.

It should be noted that although expansion forming is commonly used to produce tubular articles having defined hollow spaces, said hollow spaces do not necessarily need to be completely limited in cross section. A blank could, for example, be C shaped, i.e. have an open cross section, which does not follow a closed path but only partially encloses a hollow space and a pressure medium adapted to be introduced therein.

As described above, the present invention allows expansion forming of large articles at a reasonable price. Moreover, the inventor has realised that although a single diaphragm as described in WO 00/00309 A1 can be used to some extent for pressure compensation, its service life is relatively short because it is easily exposed to wear. According to a further aspect of the invention, the problem of the service life of a single diaphragm is solved by replacing it with a plate of the type described above.

Thus, according to yet another aspect of the invention, a device for expansion forming of an article is provided. The device comprises a pressure transmitter, which is applicable to an outer face of the tool for exerting pressure thereon and which is adapted to equalize, during the expansion forming, pressure differences between different portions of said outer face. The pressure transmitter comprises a flexible lamella or plate, preferably of metal, such as high-strength sheet metal, for example sheet steel, which plate is provided with a seal along its circumference and defines a pressure cell adapted to be filled with a liquid, the internal forming forces in the tool being intended to be compensated for provided by a liquid pressure exerted by the pressure cell and transmitted through the flexible plate.

A plate, in particular of metal, is more resistant than an elastic diaphragm and has a peripheral seal only, which when worn can be easily replaced instead of having to replace a whole diaphragm.

Unlike the expanding and stretching motion of a single diaphragm, a plate according to the invention is preferably movable as a whole. The plate can conveniently be caused to carry out a translatory movement, i.e. a movement which means that all the points of the plate are moved in parallel the same distance, i.e. without turning the plate. This parallel movement can be used to increase the volume of the pressure cell in view of the forming operation (e.g. by lowering the plate if it is adapted to abut against the upper side of the tool) and to reduce the volume (e.g. by raising the plate). This movability can be adjustable, not only by means of a liquid, such as oil, but also by means of vacuum suction or a spring assembly or any other suitable means. Thus, when the expansion forming has been completed, the plate is removed from the tool, for example by evacuating the liquid from the pressure cell and causing the plate to spring back or be sucked back into position, whereby the tool can be easily accessed and removed from the press.

Although parallel displacement of the plate relative to, inter alia, the tool, is preferably possible, it can, during the expansion forming, be tilted to allow for parallelism deviations in the tool.

Furthermore, the pressure cell can be limited by an additional plate, the two plates being parallel and movable away from one another to allow the volume of the pressure cell to be changed.

The last-mentioned aspect of the present invention can also be combined with the features stated in connection with the other aspects of the invention. Thus, the flexible plate preferably has such a dimension or area that it covers essential the whole outer face of the tool concerned, or at least more than 70%, preferably more than 90%, for example more than 95%. Moreover, the pressure medium adapted to be pressurised inside the hollow space of the blank can be either a liquid or an elastomer, or a combination thereof. Preferably, the plate can also be used to actuate a pressure intensifier in a manner corresponding to that of the diaphragm in the device described in WO 00/00309 A1, which also applies to the other aspects of the invention. Furthermore, in addition to said plate, an additional pressure transmitter, such as another flexible plate, a diaphragm or a rubber pad, can be applied to an opposite side of the expansion forming tool. Four-sided compensation is also conceivable.

The pressure transmitters according to the present invention are well adapted to be incorporated in different types of presses in different ways. A few examples thereof will be given below with reference to the accompanying drawings.

DETAILED DESCRIPTION OF PREFERRED EMBODIMENTS

Figure 1:
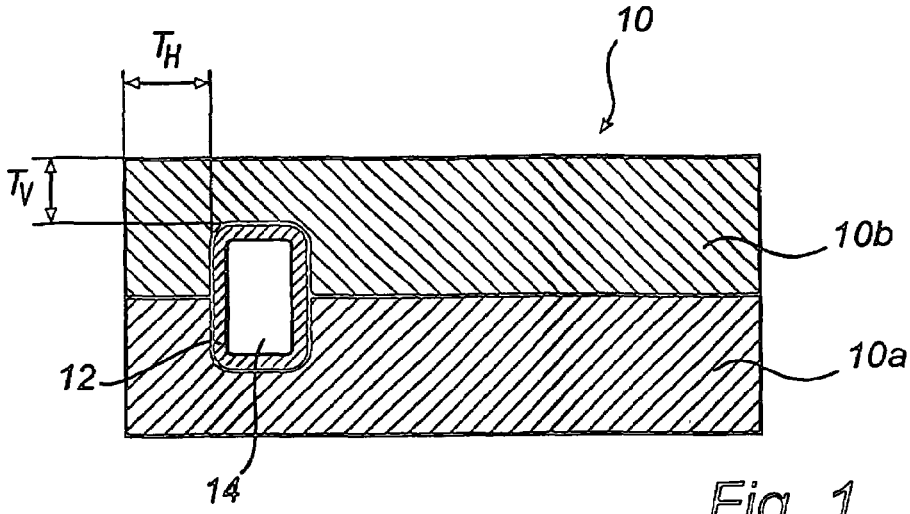
FIG. 1 is a cross-sectional view of an expansion forming tool with an initial blank or a workpiece arranged in the cavity.

FIG. 1 is a cross-sectional view of an expansion forming tool 10 with an initial blank 12 or a workpiece arranged in the cavity. The tool 10 consists of two tool halves, namely a lower half 10*a* and an upper half 10*b*. The tool halves have hollows or recesses which, when the halves are joined together, form at least one cavity 14 (for the sake of clarity only one cavity is shown). The wall thickness of the tool 10 from the cavity to the exterior is indicated in the figure by $T_V$ for the vertical thickness and $T_H$ for the horizontal thickness. Depending on the thickness and rigidity of these walls and the internal forming pressure, it may be appropriate to pressure-compensate said walls by means of an external application of force. If pressure compensation is not provided or provided in an incorrect manner, deformations may arise, as illustrated in FIGS. 2*a-b* and 3*a-b*.

Figure 2A:
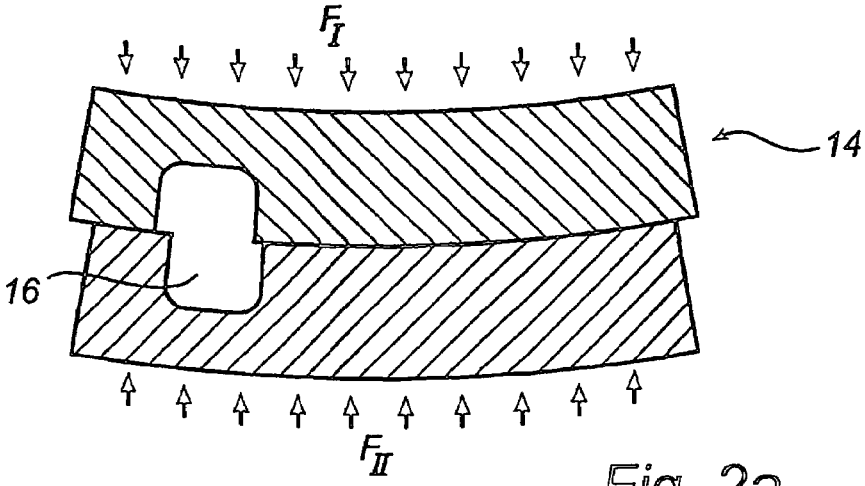
FIG. 2*a* is a cross-sectional view of an expansion forming tool which is exposed to an uneven load.
Figure 2B:
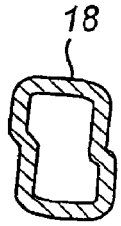
FIG. 2*b* illustrates the shape of an article as a result of the uneven load in FIG. 2*a*.

FIG. 2 is a cross-sectional view of an expansion forming tool 14, which is exposed to an uneven load. The defect shown, which may occur in a tool 14, is usually caused by a downward deflection in a conventional closing press on the under side, which cannot resist the pressure from above. In the Figure, the force $F_I$ is thus greater than the force $F_{II}$. For instance, a piston press may press on the tool from above, which leads to the cavity 16 being unevenly displaced, the result of the forming being illustrated in FIG. 2*b*. The article 18 has been bent in an incorrect manner.

Figure 3A:
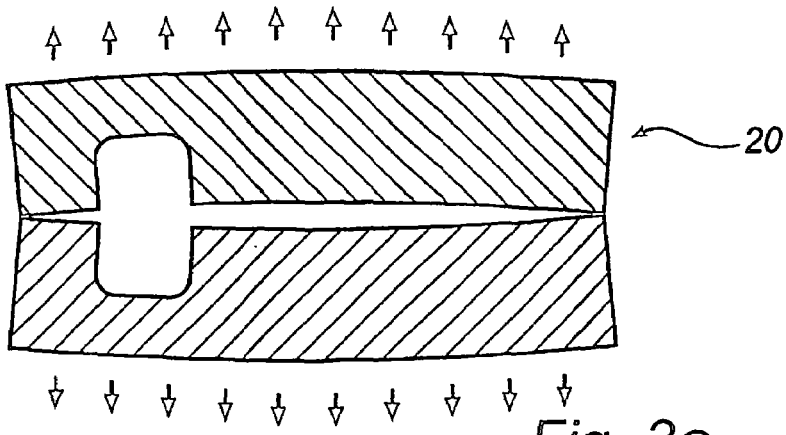
FIG. 3*a* is a cross-sectional view of an expansion forming tool in which the closing pressure is too low or the deformation too extensive.
Figure 3B:
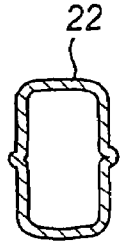
FIG. 3*b* illustrates the shape of an article as a result of the treatment according to FIG. 3*a*.

FIG. 3*a* is a cross-sectional view of an expansion forming tool 20 in which the closing pressure is too low or the deformation to extensive. The internal forming pressure is thus to high, which is illustrated by the arrows oriented away from the tool 20. FIG. 3*b* illustrates the shape of an article 22 as a result of the treatment according to FIG. 3*a*.

Figure 4:
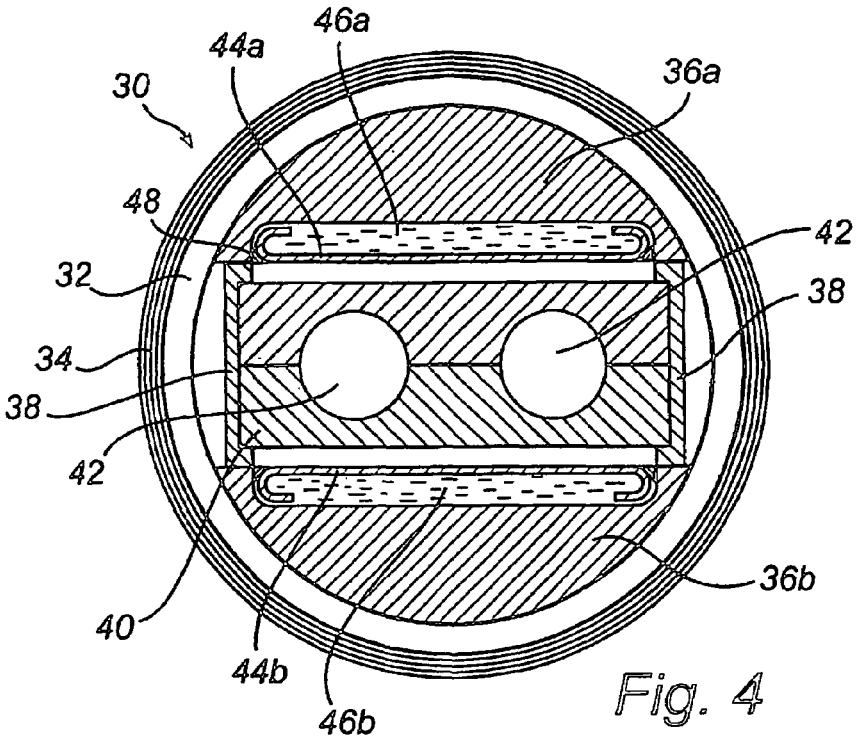
FIG. 4 is a cross-sectional view of a press in which a device is used according to one embodiment of the present invention.

FIG. 4 is a cross-sectional view of a press 30 in which a device is used according to one embodiment of the present invention. The press 30 comprises a forged cylinder 32, which has been prestressed by providing the outside of the cylinder with a metal wire 34 wound in several turns around the circumference of the cylinder 32. Inside the cylinder 32, an upper and a lower semi-circular element or yoke 36*a* and 36*b*, respectively, are arranged. Side beams 38 or supporting elements extend between them along the inner wall of the cylinder. An expansion forming tool 40 is arranged in the centre of the press 30 between the yokes 36*a,b* and the side beams 38. The expansion forming tool 40 is adapted to be inserted in the press 30 and removed therefrom transversely to the cross-sectional plane. The forming tool 40 has two cavities 42, allowing two articles to be formed simultaneously by means of expansion forming. An elastic diaphragm 44*a*, typically made of an elastomer, is applicable to the upper side of the tool 40, said diaphragm 44*a* and the upper yoke 36*a* forming a pressure cell 46*a*. The diaphragm 44*a* is provided with an enclosing seal 48 against the upper yoke 36*a*. When oil is supplied to the sealed pressure cell 46*a*, the elastic diaphragm 44*a* is caused to expand and will exert pressure on the underlying tool 40. Correspondingly, a lower diaphragm 44*b*, which together with the lower yoke 36*b* forms a pressure cell 46*b*, is caused to exert pressure on the under side of the tool. These diaphragms 44*a,b* will transmit the liquid pressure, which is the same in the two pressure cells 46*a,b*, and counteract the internal forming pressure during the actual expansion forming. The forged, prestressed cylinder 32 acts as an external force-absorber which absorbs the large closing forces that are generated. The press 30 has an effective working face of 2*4 m and a closing force of 150 000 tons (about 1500 MN) at a liquid pressure on the diaphragms of 1400 bar.

It should be noted that although the expansion forming tool shown in this figure and in the following figures has two cavities, any number of cavities is conceivable in a tool. Thus, a tool may have only one cavity, or more than two, for example three or four cavities, etc.

Figure 5:
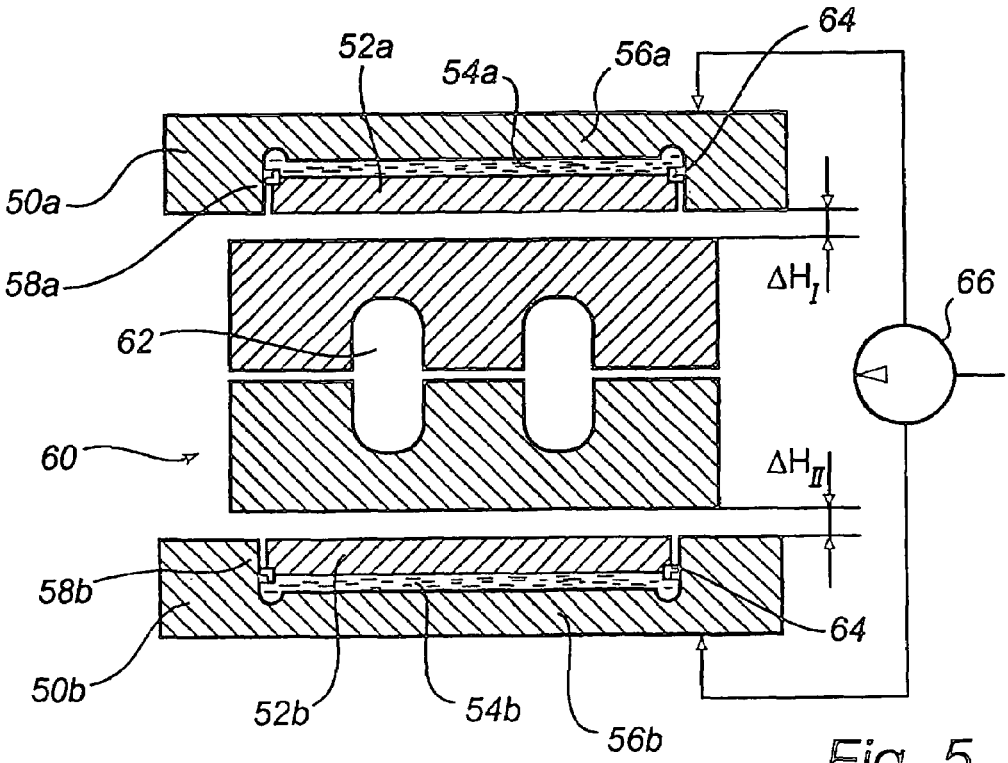
FIG. 5 illustrates two-sided pressure compensation according to another embodiment of the invention.

FIG. 5 illustrates two-sided pressure compensation according to another embodiment of the invention. Like FIG. 4, the press comprises a forged cylinder. However, FIG. 5 illustrates only schematically an upper press body part 50*a* and a lower press body part 50*b*, which are contained in the cylinder. The press body parts 50*a,b* each form, together with an associated metal plate 52*a* and 52*b*, a pressure cell 54*a,b*. Each pressure cell 54*a* and 54*b* is thus defined by a horizontal metal plate 52*a,b* or metal lamella, a horizontal portion 56*a,b* of each press body part 50*a,b* and a circumferential, vertical portion 58*a,b* of each press body part 50*a,b*. The transition between said horizontal portion and said vertical portion has the form of an indentation, among other things to reduce the stress in the material.

An expansion forming tool 60 having two cavities 62 is arranged between the two metal plates 52*a* and 52*b*. An initial blank or a workpiece to be formed by means of expansion is usually arranged between the tool halves constituting the tool in such manner that it abuts tightly against said tool; its dimension may even be slightly larger than that of a cavity 62. For this reason, it can sometimes be difficult to close the tool 60 without applying an external force. For an expansion forming tool 60 to be easily insertable in the press, there should be an upper and a lower gap between the tool 60 and respectively the upper 50*a* and the lower 50*b* press body part. These gaps or heights are designated $\Delta H_I$ and $\Delta H_{II}$. Moreover, it is possible to retract the metal plates 52*a,b* away from the tool 60 in the direction of the opposite horizontal portion 56*a,b* of the press body part 50*a,b*.

Both metal plates 52*a,b* are flexible and each of them is provided with a circumferential seal 64 providing a tight connection to the vertical portion 58*a,b* of each press body part 50*a,b*, so that no hydraulic liquid can flow past the metal plate. Hydraulic liquid is supplied from a common hydraulic system 66, and both pressure cells 54*a,b* are thus pressurised at the same time and to the same degree. Owing to the pressurising operation, the metal plates 52*a,b* are moved towards the forming tool 60 and exert together a compressive force thereon. The internal expansion forming force, which is generated by means of pressure intensifiers (not shown) will thus be counteracted on two sides. The two-side load thereby makes the tool 60 float. Any deformations are compensated for by the flexible plates 52*a,b*, which can be easily tilted to transmit the liquid pressure behind, whereby pressure differences in the tool 60 are equalized.

When the forming operation has been completed, the liquid is evacuated from the pressure cells 54*a,b* by means of vacuum suction in such manner that the metal plates 52*a,b* are pulled back from the tool 60 and that gaps, such as those designated $\Delta H_I$ and $\Delta H_{II}$, are formed which allow the tool 60 to be removed from the press. The tool halves are separated outside the press, thus allowing access to the finished article.

Figure 6:
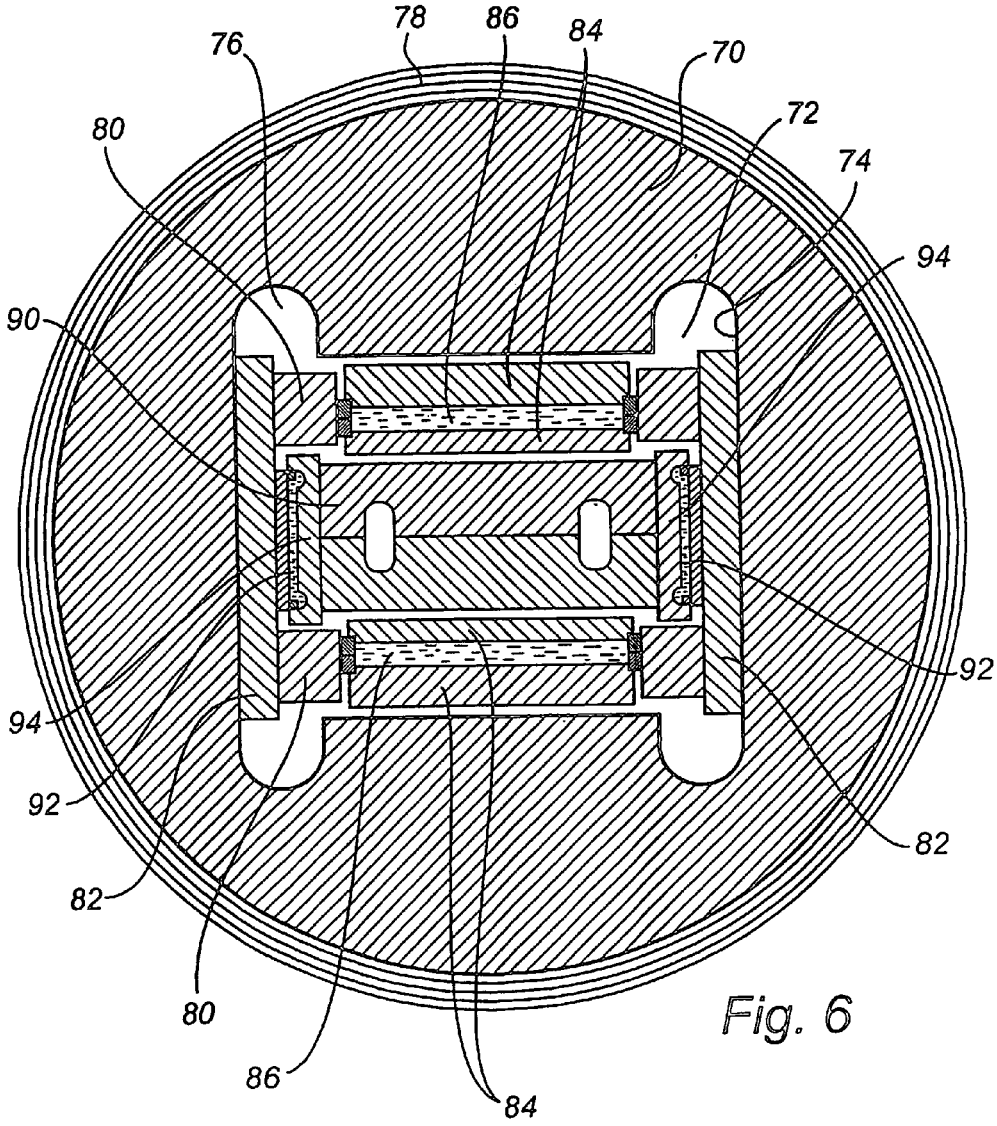
FIG. 6 illustrates four-sided pressure compensation according to a further embodiment of the invention.

FIG. 6 illustrates four-sided pressure compensation according to a further embodiment of the invention. The press body proper comprises a plurality of disc-shaped lamellar means 70 the main surfaces of which are located in vertical planes. The lamellar means 70 are arranged side by side in such manner that the disc plane or main surface of each lamellar means is parallel to the disc plane of the other lamellar means. Each lamellar means is provided with a central through hole 72, which is limited by an inner edge surface 74. The hole 72 is essentially quadrangular, but has no real corners. Instead, the "corner regions" 76 are rounded indentations in the wall, thus providing a larger opening area. The radii of these indentations are made relatively large to minimise the stress concentrations in the corner regions 76. The lamellar means 70 is formed of hot-rolled sheet steel with a thickness of 120 mm, preferably by means of milling or cutting. The height and width of the lamellar means are typically about 4000 mm and 3500 mm, respectively. Each lamellar means 70 is wound along its outer edge surface with a metal band 78 having a width essentially corresponding to the thickness of the lamellar means.

Thus, FIG. 6 is a cross-sectional view of a lamellar means 70. In the through hole 72 of the vertical lamellar means, two inner, horizontal lamellar means 80 are arranged, namely an upper and a lower one. These two inner, horizontal lamellar means extend through the whole row of vertical lamellar means 70. The inner, horizontal lamellar means 80 are arranged between inner side walls 82 extending through all the vertical lamellar means 70 along the periphery of the openings 72 and the inner edge surface 74.

The inner, horizontal lamellar means 80 are ring-shaped and each is provided with a central hole. Metal plates 84 are movably arranged in these central holes, two in each hole. The metal plates 84 are of the same type as those described in FIG. 5. However, in the embodiment shown in FIG. 6, each pressure cell 86 is formed of two metal plates 84 and one inner, horizontal lamellar means 80. When the pressure cell 86 is filled with a pressure medium, such as hydraulic oil, the plates 84 will be separated from one another and one of the plates of each pressure cell will be pressed against an expansion forming tool 90.

In addition to the upper and lower pressure compensation, horizontal force generators are also provided, in the form of pressure cells 92 with pressure transmitters 94, which are also movable by means of a pressure medium, such as hydraulic oil. These pressure cells 92 are thus arranged between the upper and the lower horizontal lamellar means 80. Consequently, the expansion forming tool 90 is pressure-compensated from four sides, which can be advantageous at very high pressures, but also at lower pressures if the tool has thin walls. Advantageously, the press consisting of vertical and horizontal lamellar means is capable of absorbing forces in the range 10,000-100,000 tons (100-1000 MN).

The construction of the press illustrated in FIG. 6 is described in more detail in PCT/SE01/02596, which had not yet been published at the time of filing the present application. It should be noted that four-sided compensation is conceivable also in the case of a forged press of conventional type.

Figure 7:
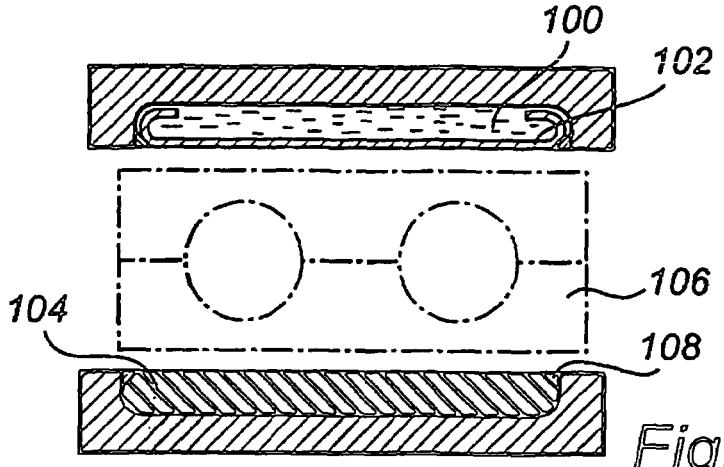
FIG. 7 illustrates two-sided pressure compensation according to yet another embodiment of the present invention.

FIG. 7 illustrates two-sided pressure compensation according to yet another embodiment of the present invention. In this embodiment, an upper pressure transmitter is provided in the form of a pressure cell 100 with a diaphragm 102. A lower pressure transmitter 104, which is adapted to influence an expansion forming tool 106 from below, comprises a rubber pad. The rubber pad 104 is provided with a seal 108 along its circumference to prevent extrusion. The rubber pad 104 is a passive element, whereas the diaphragm 102 is an active element. The diaphragm 102 transmits the liquid pressure behind it to the upper side of the tool 106. The tool 106 will in its turn exert pressure on the underlying pad 104, whose properties are similar to those of a liquid. The pressure distribution in the rubber pad 104 will be essentially hydrostatic and the rubber pad 104 will equalize any pressure differences on the under side of the tool 106.

It should be noted that although FIGS. 4, 5 and 7 show two-sided pressure compensation that is applied to the horizontal surfaces of the expansion forming tool, it is conceivable, within the scope of the invention, to apply instead two-sided pressure compensation to the vertical sides of the expansion forming tool.

Figure 8:
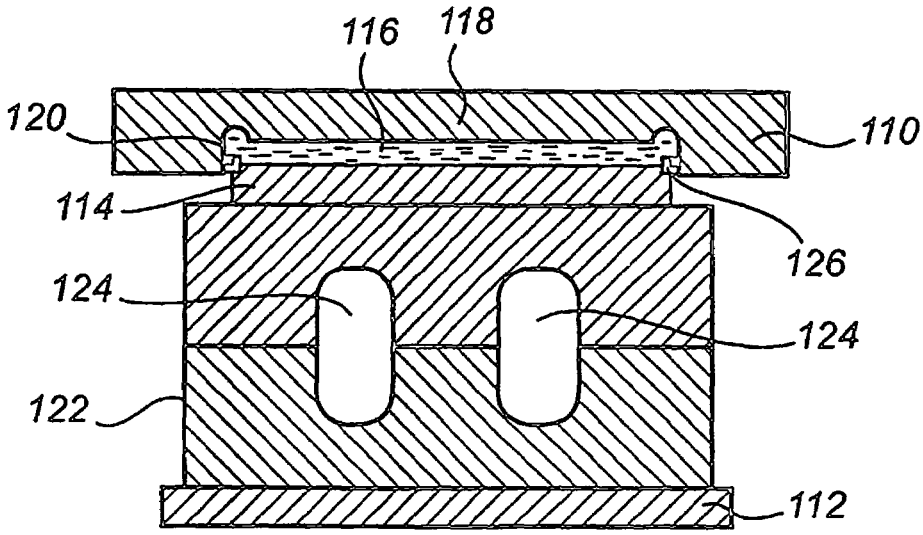
FIG. 8 illustrates one-sided pressure compensation according to one embodiment of the present invention.

FIG. 8 illustrates one-sided pressure compensation according to one embodiment of the present invention. In the figure, an upper press body part 110 and a lower press body part 112 are shown. The upper press body part 110 forms, together with a metal plate 114, a pressure cell 116. The pressure cell 116 is thus defined by a horizontal metal plate 114 or metal lamella, a horizontal portion 118 and a circumferential, vertical portion 120 of the upper press body part 110. The transition between said horizontal portion 118 and said vertical portion 120 has the form of an indentation, among other things to reduces the stress in the material.

The lower press body part 112 comprises a conventional press platen. A expansion forming tool 122 having two cavities 124 is arranged between the press platen and the metal plate.

The metal plate 114 is flexible and provided with a circumferential seal 126 which provides a tight connection to the vertical portion 120 of the upper press body part 110, so that no hydraulic liquid can flow past the metal plate 114. Hydraulic liquid is supplied from a hydraulic system (not shown). Owing to the pressurising operation, the metal plates 114 will be moved towards the forming tool 122 and exert a compressive force thereon. Any deformations are compensated for by the flexible plate 114, which can be easily tilted to transmit the liquid pressure behind, whereby pressure differences in the tool 122 are equalized.

When the forming operation has been completed, the liquid is evacuated from the pressure cell 116 by means of vacuum suction so that the metal plate 114 is pulled back from the tool 122 and a gap is formed which allows the tool to be removed from the press. The tool halves are separated outside the press, thus allowing access to the finished article.

Figure 9:
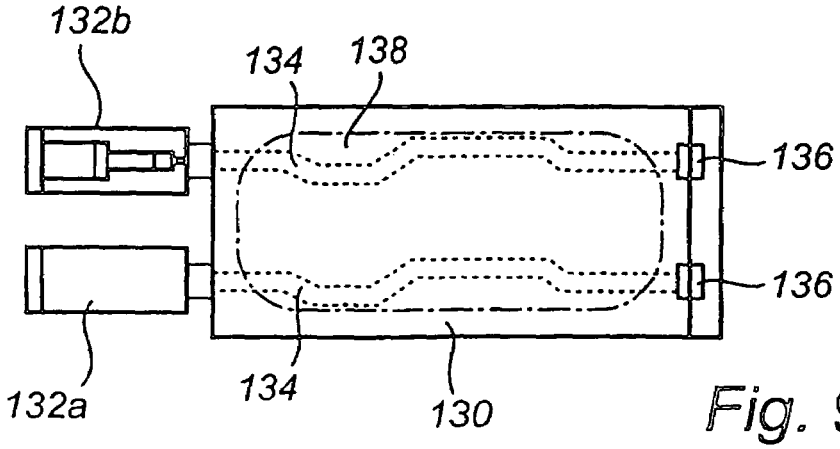
FIG. 9 is a view of an expansion forming tool to which pressure intensifiers are connected.

FIG. 9 is a top view of an expansion forming tool 130 to which two pressure intensifiers 132*a,b* are connected. One pressure intensifier 132*b* is illustrated schematically with its housing having been removed. The expansion forming tool 130 is quadrangular and rectangular. In the tool 130, two elongate, pre-bent tubular blanks 134 can be disposed for expansion forming thereof. One example of the extension of the blanks 134 is shown by means of dotted lines. For each blank, a plug 136 is provided at one end to prevent the pressure medium from flowing out, while the other end is connected to a pressure intensifier 132*a* and 132*b*, respectively. The pressure intensifier 132*a,b* pumps a pressure medium into the hollow spaces of the blanks and increases the pressure so that the blanks are expanded against the inner cavity wall of the tool 130.

Furthermore, a dash and dot line indicates a pressure transmitter 138, such as a diaphragm or a metal plate, which is adapted to be applied to the forming tool 130 for the purpose of pressure compensation. The pressure transmitter 138 has essentially the form of a rectangle, without any real corners, and covers a large part of the forming tool 130.

It should also be noted that, instead of the plugs 136, two pressure intensifiers of a type corresponding to the pressure intensifiers 132*a* and 132*b* can be arranged at the same location. In this case, it will be possible to pressurise each tubular blank from both ends at the same time.

Figure 10:
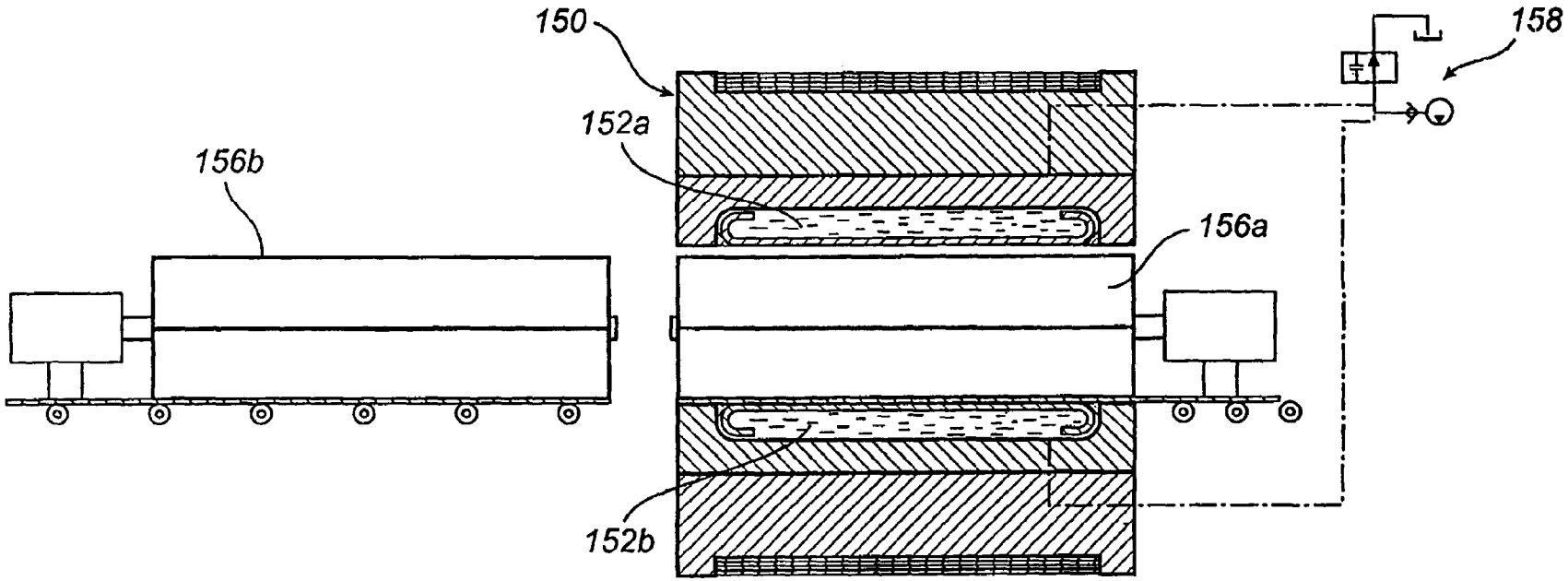
FIG. 10 illustrates one-example of handling expansion forming tools.

FIG. 10 illustrates one example of handling expansion forming tools. The press 150 is of the same type as that shown in FIG. 4. Thus, an upper pressure cell 152*a* and a lower pressure cell 152*b* with diaphragms are included, an expansion forming tool being insertable between them. To obtain satisfactory production efficiency, at least two tools 156*a,b* are used in a press. When one tool 156*a* is situated inside the press for expansion forming a blank into a finished article, the other tool 156*b* is located outside the press. Using a manipulator (not shown), the upper tool half of the other tool 156*b* is lifted to allow a finished article to be removed from the tool 156*b* and a new blank is arranged in its place. The manipulator then lowers the upper tool half and keeps the halves in a compressed state. When the tool 156 situated in the press 150 is removed from one end thereof, the other, prepared tool 156 is simultaneously introduced in the press 150 from the other end. The expansion of the diaphragms is controlled by means of a hydraulic system 158, which during the tool change empties the pressure cells 152*a,b* by means of vacuum suction in such manner that a gap is formed between each diaphragm and the tool to be taken out, which also allows easy insertion of the new tool. In the embodiment shown, the lower pressure cell 152*b* is situated below the ground level, for example embedded in the floor. However, other alternatives are also conceivable.

It follows from the above description that the present invention can be used to avoid such deflections that are caused by conventional closing means. The invention further offers the opportunity to reduce the dimensions of the tool itself, since the internal forming forces are counteracted by an external liquid pressure transmitted through a pressure transmitter of the kind described above. The invention thus allows a high degree of accuracy to be obtained in the articles produced by means of expansion forming.

The invention claimed is:

1. A device for expansion forming of an article, used in conjunction with a press, comprising:

an expansion forming tool, which comprises at least one cavity adapted to receive a blank having an inner hollow space and at least two separate tool parts;

at least one pressure intensifier, which is adapted to pressurize a pressure medium in the hollow space of the blank in such manner that the blank is forced against the wall of the forming space, the blank being thus expanded into an article shaped according to the shape of the cavity;

a first pressure transmitter comprising a flexible element, which flexible element is applicable to a first outer face of a first tool part of the tool for exerting pressure thereon and which is adapted to equalize, during the expansion forming, pressure differences between different portions of said first outer face; and a second pressure transmitter comprising a flexible element, which flexible element is applicable to a second outer face of a second tool part of the tool for exerting pressure thereon and which is adapted to equalize, during the expansion forming, pressure differences between different portions of said second outer face, wherein the first and the second face are located opposite one another and oriented away from one another such that pressures exerted by the first and the second pressure transmitters on the first and second outer faces, respectively, act to close the first and the second tool parts.

2. A device as claimed in claim 1, wherein the flexible element defines a pressure cell adapted to be filled with a liquid, the internal forming forces in the tool being intended to be compensated for by a liquid pressure exerted by the pressure cell and transmitted through the flexible element.

3. A device as claimed in claim 2, wherein said flexible element is an elastic diaphragm.

4. A device as claimed in claim 2, wherein said flexible element is a plate, which plate is provided with a seal along its circumference, the whole plate being movable to allow the volume of the pressure cell to be changed.

5. A device as claimed in claim 2, wherein the pressure transmitters each comprise a flexible element, which defines a pressure cell adapted to be filled with a liquid, which pressure cells are connected to a common liquid source adapted to supply liquid to them, thus allowing the same pressure to be achieved in both pressure cells.

6. A device as claimed in claim 2, wherein the first pressure transmitter comprises a flexible element, which defines a pressure cell adapted to be filled with a liquid, and the second pressure transmitter comprises a pad-shaped element made of an elastomer or an equivalent rubber like material, which pad-shaped element is provided with a seal along its circumference, the first pressure transmitter provided with a pressure cell being adapted to actively exert a force on the tool, while the second pressure transmitter is passive and acted upon through the tool by the first pressure transmitter, the pressure distribution in the pad-shaped element being substantially hydrostatic.

7. A device as claimed in claim 1, wherein the first pressure transmitter and the second pressure transmitter each comprise a pad-shaped element made of an elastomer or an equivalent rubber-like material, which pad-shaped elements are provided with a seal along their circumference and adapted to abut against the tool, a force-exerting means being arranged to exert a force in the direction of the tool on at least one of said elements such that the latter transmits the force to the tool, the pressure distribution in the pad-shaped elements being substantially hydrostatic.

8. A device as claimed in claim 1, wherein the at least two separable tool parts, which are adapted, during the expansion forming, to abut against one another in a plane which is parallel to said first outer face and said second outer face.

9. A device as claimed in claim 1, further comprising:

a third pressure transmitter, which is applicable to a third outer face of the tool for exerting pressure thereon and which is adapted to equalize, during the expansion forming, pressure differences between different portions of said third outer face; and a fourth pressure transmitter, which is applicable to a fourth outer face of the tool for exerting pressure thereon and which is adapted to equalize, during the expansion forming, pressure differences between different portions of said fourth outer face, the third and the fourth outer face being located opposite one another and oriented away from one another, and the third and the fourth outer face being perpendicular to the first and the second outer face.

10. A device as claimed in claim 1, wherein each pressure transmitter has a dimension such that, during the expansion forming, covers substantially the associated outer face of the tool.

11. A device as claimed in claim 1, wherein the pressure medium intended to be pressurized in the hollow space of the blank comprises a substance selected from the group consisting of: (a) a liquid; (b) an elastomer or any other rubber-like material; and (c) a combination of the substances indicated in (a) and (b).

12. A device as claimed in claim 4, wherein said plate is made of metal.

13. A device as claimed in claim 12, wherein said metal is a high-strength sheet metal.

14. A device as claimed in claim 12, wherein said metal is sheet steel.

15. A device as claimed in claim 1, wherein each pressure transmitter has a dimension such that, during the expansion forming, at least more than 70% of the outer face of the tool associated with each pressure transmitter is covered.

16. A device as claimed in claim 15, wherein more than 90% of said outer face is covered.

17. A device as claimed in claim 15, wherein more than 95% of said outer face is covered.

18. A method for expansion forming of an article, comprising arranging a blank having an inner hollow space in the cavity of an expansion forming tool comprising at least two separate tool parts;

pressurizing a pressure medium in the hollow space of the blank in such manner that the blank is forced against the wall of the cavity, the blank being thus expanded into an article shaped according to the shape of the cavity;

exerting pressure on a first outer face of a first tool part of the expansion forming tool and equalizing, during the expansion forming, pressure differences between different portions of said first outer face;

exerting pressure on a second outer face of a second tool part of the expansion forming tool and equalizing, during the expansion forming, pressure differences between different portions of said second outer face, the first and the second outer face being located opposite one another and oriented away from one another: and closing the first and the second tool part by exerting pressure on the first and second outer faces.

19. A method as claimed in claim 18, wherein the exertion of pressure on at least one outer face is achieved by pressurizing a liquid and transmitting the liquid pressure through a flexible element to said outer face in order to compensate for the internal forming forces in the tool.

20. A method as claimed in claim 19, wherein the first outer face is actively acted upon by a liquid pressure transmitted through a flexible element, while a pad-shaped element made of an elastomer or an equivalent rubber-like material is applied to the second outer face for passive application of pressure.

21. A method as claimed in claim 18, wherein at least the first outer face is actively acted upon by a force being exerted on a first pad-shaped element applied to said face and made of an elastomer or an equivalent rubber-like material, for transmitting the force to the first outer face, while a second pad-shaped element made of an elastomer or an equivalent rubber-like material is applied to the second outer face for passive application of pressure.

22. A method as claimed in claim 18, further comprising:

exerting pressure on a third outer face of the expansion forming tool and equalizing, during the expansion forming, pressure differences between different portions of said third outer face; and exerting pressure on a fourth outer face of the expansion forming tool and equalizing, during the expansion forming, pressure differences between different portions of said fourth outer face, the third and the fourth outer face being located opposite one another and oriented away from one another, and the third and the fourth outer face being perpendicular to the first and the second outer face.

23. A method as claimed in claim 18, wherein pressure is exerted on substantially the whole of said outer faces of the tool.

24. A method as claimed in claim 18, wherein the pressure medium intended to be pressurized in the hollow space of the blank compnses a substance selected from the group consisting of:

(a) a liquid;

(b) an elastomer or any other rubber-like material; and (c) a combination of the substances indicated in (a) and (b).

25. A method as claimed in claim 19, wherein said flexible element is an elastic diaphragm.

26. A method as claimed in claim 19, wherein said flexible element is a plate provided with a seal.

27. A method as claimed in claim 18, wherein pressure is exerted on at least more than 70% of said outer faces of the tool.

28. A method as claimed in claim 18, wherein pressure is exerted on more than 90% of said outer faces of the tool.

29. A method as claimed in claim 18, wherein pressure is exerted on more than 95% of said outer faces of the tool.

30. A device for expansion forming of an article, preferably used in conjunction with a press, comprising:

an expansion forming tool, which comprises at least one cavity adapted to receive a blank having an inner hollow space;

at least one pressure intensifier, which is adapted to pressurize a pressure medium in the hollow space of the blank in such manner that the blank is forced against the wall of the forming space, the blank being thus expanded into an article shaped according to the shape of the cavity; and a pressure transmitter, which is applicable to an outer face of the tool for exerting pressure thereon and which is adapted to equalize, during the expansion forming, pressure differences between different portions of said outer face, the pressure transmitter comprising a flexible plate, which plate is provided with a seal along its circumference and defines a pressure cell adapted to be filled with a liquid, the inner forming forces in the tool being intended to be compensated for by a liquid pressure from the pressure cell, which is transmitted through the flexible plate, wherein the flexible plate is designed to be tiltable to allow for parallelism deviations in the tool.

31. A device as claimed in claim 30, wherein the flexible plate is movable, in at least a translatory movement, to allow the volume of the pressure cell to be changed.

32. A device as claimed in claim 30, wherein the pressure cell is limited by an additional plate, the two plates being parallel and movable away from one another to allow the volume of the pressure cell to be changed.

33. A device as claimed in claim 30, wherein at least one additional pressure transmitter is applicable to the tool.

34. A device as claimed in claim 30, wherein said plate is made of metal.

35. A device as claimed in claim 34, wherein said metal is high-strength sheet metal.

36. A device as claimed in claim 35, wherein said metal is sheet steel.

* * * * *